US011028594B2

(12) United States Patent
Gonzalez et al.

(10) Patent No.: US 11,028,594 B2
(45) Date of Patent: Jun. 8, 2021

(54) SOFFIT PANEL ATTACHMENT SYSTEM

(71) Applicant: James Hardie Technology Limited, Dublin (IE)

(72) Inventors: Jose Gonzalez, Corona, CA (US); Kevin O'Leary, Fontana, CA (US); Benjamin Batres, Fontana, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/819,884

(22) Filed: Mar. 16, 2020

(65) Prior Publication Data

US 2020/0308840 A1 Oct. 1, 2020

Related U.S. Application Data

(60) Provisional application No. 62/826,339, filed on Mar. 29, 2019.

(51) Int. Cl.
*E04D 13/152* (2006.01)
*E04D 13/17* (2006.01)

(52) U.S. Cl.
CPC ..... *E04D 13/152* (2013.01); *E04D 13/178* (2013.01)

(58) Field of Classification Search
CPC ..... E04D 13/15; E04D 13/152; E04D 13/158; E04D 13/178
See application file for complete search history.

(56) References Cited

U.S. PATENT DOCUMENTS

2008/0098661 A1* 5/2008 McCann ..... E04D 13/076 52/12
2008/0148671 A1* 6/2008 Monteer ..... E04F 19/06 52/533

FOREIGN PATENT DOCUMENTS

GB 2115920 A * 9/1983 ..... F24F 7/00
GB 2140841 A * 12/1984 ..... E04D 13/158
GB 2231398 A * 11/1990 ..... E04D 13/178
GB 2306979 A * 5/1997 ..... E04D 13/152

* cited by examiner

*Primary Examiner* — Christine T Cajilig
(74) *Attorney, Agent, or Firm* — Knobbe Martens Olson & Bear LLP

(57) ABSTRACT

A soffit panel attachment device includes a central portion, an attachment surface, a plurality of flanges, and a plurality of openings extending through the central portion. The attachment surface extends perpendicularly from the central portion at a first end of the central portion. First and second flanges extend parallel to the central portion to form a U-shaped channel sized and shaped to receive a soffit covering material. Two soffit panel attachment devices may be installed in opposing configurations such that the U-shaped channels are positioned to support opposite ends of a soffit panel material. The plurality of openings may be a grid of hexagonal or circular openings that provide airflow paths across the soffit panel material such as from an exterior space into an attic space above the soffit.

16 Claims, 11 Drawing Sheets

SOFFIT PANEL ATTACHMENT SYSTEM

CROSS-REFERENCE TO RELATED APPLICATIONS

This application claims the benefit of U.S. Provisional Application Ser. No. 62/826,339, filed Mar. 29, 2019, entitled "SOFFIT PANEL ATTACHMENT SYSTEM," which is hereby incorporated by reference in its entirety and for all purposes.

FIELD

The present disclosure generally relates to an attachment device suitable for use with soffit material, in particular a vented attachment device and methods of installation of same.

BACKGROUND

Any discussion of the prior art throughout the specification should in no way be considered as an admission that such prior art is widely known or forms part of the common general knowledge in the field.

In many instances, the exposed exterior under surfaces of overhanging sections of a roof structure are lined with soffit material. Soffit materials are generally installed by fixing soffit boards directly to the under surface of the overhanging sections of a roof, for example to a nailing surface commonly known as blocking adjacent the external vertical wall of the building and an opposing fascia or sub-fascia.

Commonly under-eave vents are placed in an opening in the soffit material to provide ventilation to an attic space beneath the roof structure. Such vents operate in conjunction with roof or ridge vents to provide ventilation within the attic space by enabling a natural flow of air through the attic space. In practice, air rises and exits the attic space through the roof vents causing further cooler air to be drawn in through the under-eave vents.

It is desirable to provide an attachment device capable of securing soffit material in position such that the soffit material lines the exposed exterior under surface of the overhanging section of the roof whilst also providing under-eave ventilation.

SUMMARY

The systems, methods and devices described herein address one or more problems as described above and associated with current soffit lining systems. The systems, methods and devices described herein have innovative aspects, no single one of which is indispensable or solely responsible for their desirable attributes. Without limiting the scope of the claims, the summary below describes some of the advantageous features.

According to the present disclosure there is provided an attachment device comprising an attachment surface extending substantially orthogonally from a central portion and at least two flanges extending substantially laterally from the central portion such that a U-shaped receiving channel is formed whereby the central portion forms the base of the U-shaped receiving channel and the flanges form opposing side arms of the U-shaped receiving channel. In some embodiments the U-shaped receiving channel is remote from the attachment surface.

In some embodiments the central portion comprises a vented section having a first major face and a second major face spaced apart from each other and an intermediate portion positioned between the first and second major faces. The vented section further comprises a plurality of apertures extending from an outer surface of the first major face, through the intermediary portion to an outer surface of the second major face such that an open channel extends between the first and second major faces of the attachment device. The apertures are configured to allow air to move through the vented section between the first major face and the second major face. In certain embodiments, the diameter of each aperture ranges between, for example, ⅛" and 1/16", but may have other sizes such as between ¼" and 1/16".

In some embodiments, each aperture is configured to have either a circular or hexagonal cross sectional shape. Other suitable cross-sectional shapes could also be used, for example, square shapes, triangular shapes, any other regular or irregular polygonal shapes, oval, obround, or stadium shapes, and the like. In some implementations, circular or hexagonal cross sectional shapes as illustrated herein may provide advantageous aperture packing efficiency and strength in the designated vented section.

In some embodiments, each aperture is configured to act as an air inlet which allows cool air to be drawn in to the attic space when in use as a soffit material lining the underside of eaves. The net free ventilation figure can be used to calculate how many feet of the vented soffit attachment device is required to line the underside of eaves based on the calculated Net Free Area (NFA) to achieve a balanced ventilation system for a particular roof system.

One advantage of certain embodiments of the attachment device is that there is an aesthetically pleasing method of securely fastening soffit material to the exposed under surface of an overhanging roof structure. For example, in some embodiments the disclosed attachment devices are fastened to an eave structure by inserting one or more fasteners through a vertical attachment surface that is not visible from the exterior when a soffit panel has been installed, such that the finished roof system does not have any soffit panel fasteners such as nails that are visible from the exterior. In some embodiments, the attachment devices include an aesthetically pleasing regular array of shapes such as circular openings, hexagonal openings, or the like.

A further advantage is that there may be an increase in the net free ventilation figure achieved by the roof system, for example, due to the inclusion of ventilation features within an attachment device for soffit panel articles. In some embodiments, the disclosed attachment systems and devices may be used with soffit panels that additionally include ventilation features.

One advantage of certain embodiments is that the attachment device may suitable for use in high risk fire zone areas. For example, the length of each opening between the first and second major faces of an attachment device may be sufficient to prevent certain particulate materials, such as some embers, sparks, or the like, from entering an attic space.

In a further embodiment, there is provided a soffit lining system comprising one or more various embodiments of the attachment device together with a soffit material.

In a further embodiment, there is provided a soffit lining system comprising one or more various embodiments of the attachment device together with a vented soffit material. In some embodiments the vented soffit material comprises a vented fiber cement article, the vented fiber cement article comprising:

a panel comprising a first major face, a second major face and an intermediate portion positioned between the first and second faces such that the first face, second face and intermediate portion together form the panel; and a plurality of openings extending between the first and second major faces of the panel through the intermediate portion such that a vented portion is formed in the panel;

wherein the surface area of the plurality of openings of the vented fiber cement article comprises between approximately 9% and 15.5% of the total surface area of the vented portion of the fiber cement article per linear foot such that the net free ventilation of the vented fiber cement article is between 10 and 16 square inches per linear foot.

The present application also provides a method of installing a soffit material, the method comprising:

attaching a first and second attachment device to a first and second surface respectively, wherein the u-shaped receiving channels of the first and second attachment devices are spaced apart and opposite each other;

inserting a soffit material into the space between the opposing u-shaped receiving channels of the first and second attachment devices such that the soffit material is held in place by opposing u-shaped receiving channels.

In some embodiments, the first attachment device is attached to the fascia or sub-fascia of the overhanging roof structure and the second attachment device is attached to the building wall structure such that the soffit material when installed covers the exposed under surface of the roof structure.

When the example embodiment of the attachment device is used on the underside of eaves to attach soffit material, it is preferred to provide the attachment device in long lengths for example between 2 ft and 8 ft long. Additional lengths, such as 4 ft, 12 ft, 20 ft, or longer, and/or any intermediate length therebetween, may also be provided.

In some embodiments, a soffit lining system comprises a first soffit panel attachment device coupled to a building substrate, the first soffit panel attachment device comprising a first attachment surface lying adjacent to the building substrate, a first central portion perpendicular to the building substrate and coupled to the first attachment surface at a first end of the first central portion, and a first plurality of flanges extending from the first central portion at a second end of the first central portion opposite the first end, the first plurality of flanges disposed parallel to the first central portion to form a first U-shaped channel aligned with the first central portion and opening away from the building substrate; a second soffit panel attachment device coupled to a framing member spaced outwardly from the building substrate, the second soffit panel device comprising a second attachment surface lying adjacent to the framing member, a second central portion parallel to the first central portion and coupled to the second attachment surface at a first end of the second central portion, and a second plurality of flanges extending from the second central portion at a second end of the second central portion opposite the first end, the second plurality of flanges disposed parallel to the second central portion to form a second U-shaped channel aligned with the second central portion and opening toward the first U-shaped channel, wherein the second soffit panel attachment device comprises a plurality of openings extending through the second central portion; and a soffit panel having a substantially planar surface comprising a first edge and a second edge opposite the first edge, the soffit panel disposed at least partially within the first and second U-shaped channels, the first edge being disposed within the first U-shaped channel and resting on one of the first plurality of flanges, the second edge being disposed within the second U-shaped channel and resting on one of the second plurality of flanges, such that the first and second soffit panel attachment devices support the soffit panel along a length of the soffit panel.

In some embodiments, the plurality of openings are oriented perpendicular to the soffit panel to provide an airflow path between a space below the soffit panel and a space above the soffit panel. In some embodiments, the plurality of openings comprise a regularly spaced grid of circular openings covering at least 0.4 square inches of each square inch of total surface area of the grid. In some embodiments, the plurality of openings comprise a regularly spaced grid of hexagonal openings covering at least 0.4 square inches of each square inch of total surface area of the grid. In some embodiments, the first soffit panel attachment device does not include a plurality of openings extending through the first central portion. In some embodiments, the first soffit panel attachment device includes a plurality of openings extending through the first central portion. In some embodiments, the first soffit panel attachment device is substantially identical to the second soffit panel attachment device.

In another embodiment, a soffit panel attachment device comprises a central portion comprising a first major face, a second major face parallel to the first major face, and an intermediate portion disposed between the first major face and the second major face; an attachment surface comprising a substantially planar surface extending perpendicularly from the central portion at a first end of the central portion; a first flange parallel to the central portion, the first flange extending from the central portion proximate the first major face at a second end of the central portion opposite the first end; a second flange parallel to the first flange, the second flange extending from the central portion proximate the second major face at the second end such that the first flange, the second flange, and the second end of the central portion form a U-shaped channel sized and shaped to receive a soffit covering material; and a plurality of openings extending through the intermediate portion to form a plurality of airflow paths through the central portion from the first major face to the second major face.

In some embodiments, the plurality of openings comprise a regularly spaced grid of hexagonal apertures. In some embodiments, the plurality of openings comprise a regularly spaced grid of circular apertures. In some embodiments, individual apertures of the plurality of apertures are spaced apart by a distance of between approximately 0.2 inches and approximately 0.3 inches. In some embodiments, the soffit panel attachment device comprises a single integrally formed piece of a polymeric material. In some embodiments, the plurality of openings generally define a ventilated area of the central portion, and wherein the plurality of openings occupy at least 0.4 square inches of each square inch of the ventilated area. In some embodiments, each opening of the plurality of openings has a diameter of between approximately ⅛ inch and approximately 1/16 inch. In some embodiments, the attachment surface comprises a plurality of apertures extending therethrough, each aperture of the plurality of apertures sized and shaped to receive a mechanical fastener therethrough. In some embodiments, the soffit panel attachment device has a length of between approximately 2 feet and approximately 8 feet. In some embodiments, the length of the soffit panel attachment device is approximately 4 feet.

For the purposes of this specification, the term 'comprise' shall have an inclusive meaning. Thus it is understood that it should be taken to mean an inclusion of not only the listed components it directly references, but also non specified components. Accordingly, the term 'comprise' is to be attributable with as broad an interpretation as possible and this rationale should also be used when the terms 'comprised' and/or 'comprising' are used.

Further aspects or embodiments of the present invention will become apparent from the ensuing description which is given by way of example only.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1A:
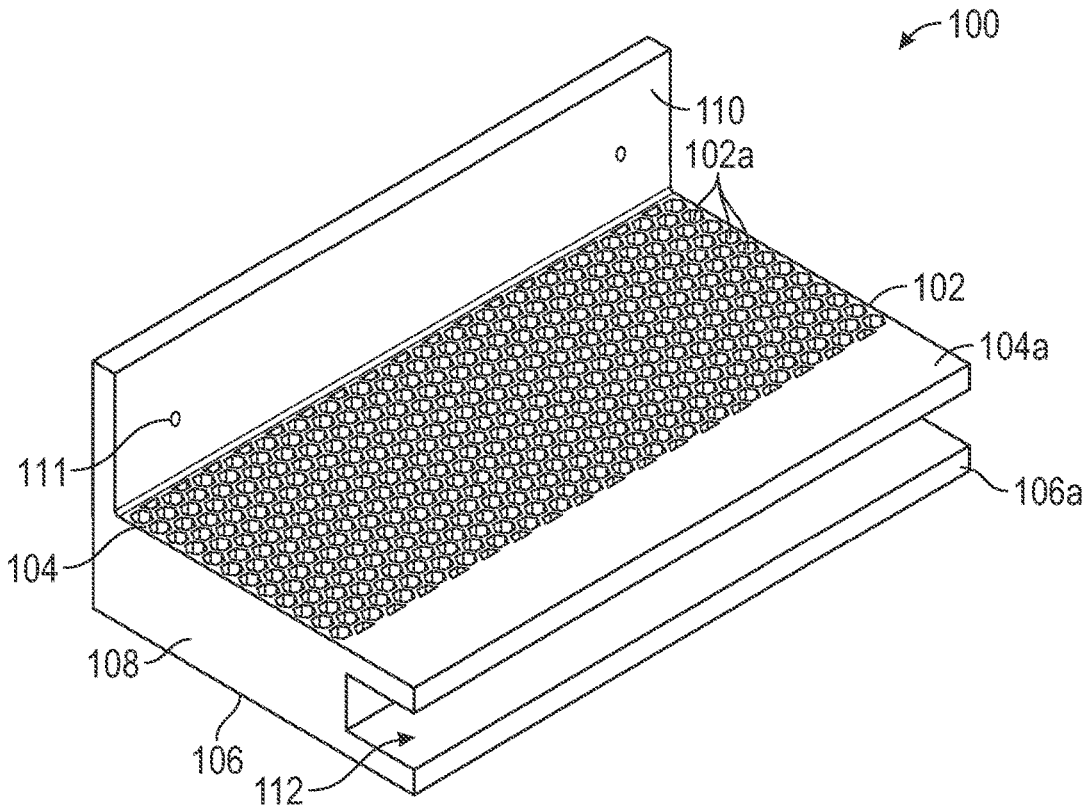
FIG. 1A is a perspective view of an example attachment device in accordance with the present technology.
Figure 1B:
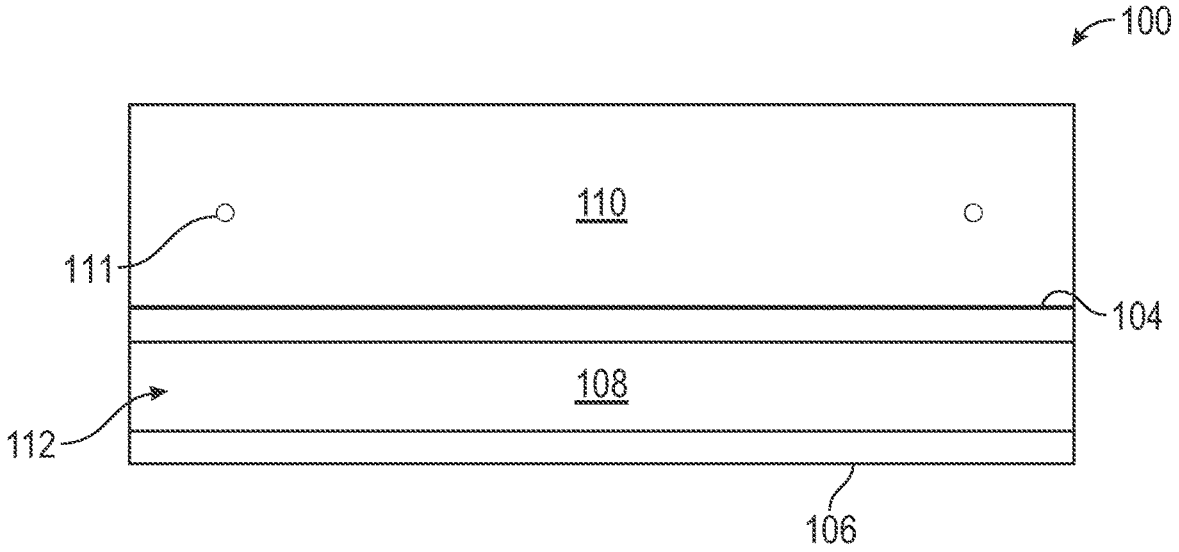
FIG. 1B is a front view of the attachment device of FIG. 1A.
Figure 1C:
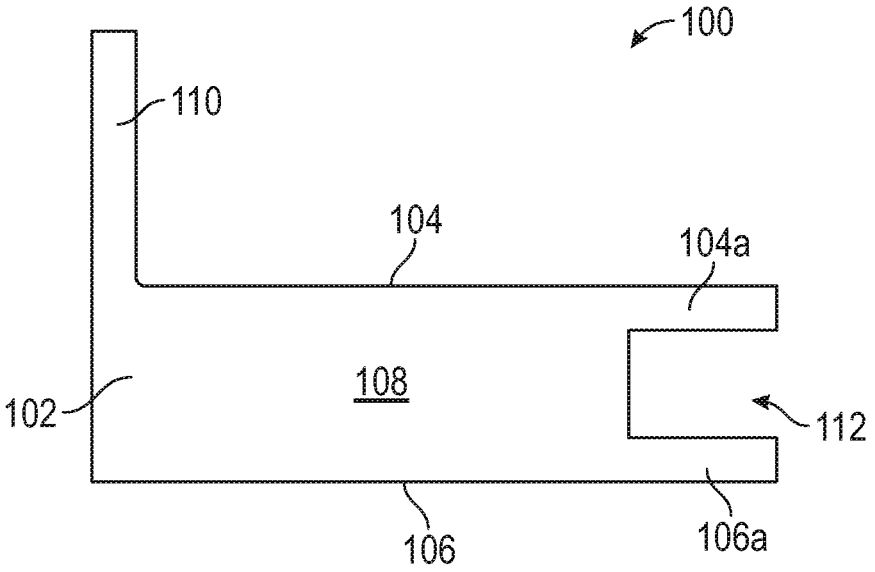
FIG. 1C is a side view of the attachment device of FIG. 1A.

Although the present disclosure is described with reference to specific examples, it will be appreciated by those skilled in the art that the present disclosure may be embodied in many other forms. The embodiments discussed herein are merely illustrative and do not limit the scope of the present disclosure.

In the description which follow, like parts may be marked throughout the specification and drawings with the same reference numerals. The drawing figures are not necessarily to scale and certain features may be shown exaggerated in scale or in somewhat generalized or schematic form in the interest of clarity and conciseness.

Referring now to the drawings and specifically to FIGS. 1A to 1D, there is shown an attachment device 100 in accordance with the present technology. Attachment device 100 comprises a central portion 102 having a first major face 104 and a second major face 106, wherein the first and second major faces 104, 106 are spaced apart from each other. Central portion 102 further comprises a plurality of apertures 102*a* which extend from an outer surface of the first major face 104, through an intermediary portion 108 to an outer surface of the second major face 106 such that each aperture forms an open channel extending between the first and second major faces 104, 106 of the attachment device 100. Apertures 102*a* are configured to allow air to move through the vented section of the central portion 102 between the first major face 104 and the second major face 106. In use, this allows each aperture 102*a* to act as an air inlet to the area beneath a roof structure.

Vented attachment device 100 further comprises an attachment surface 110 extending substantially orthogonally from at least a portion of central portion 102. In use, the attachment surface 110 of the vented attachment device is secured to a building substrate, for example, a structural wall and/or a fascia board, such as by one or more mechanical fasteners (e.g., nails, screws, etc.) and/or by a chemical adhesive. In some embodiments, the attachment surface 110 comprises one or more apertures 111 extending therethrough for receiving mechanical fasteners for attaching the attachment device 100 to a substrate.

Attachment device 100 further comprises a flange portion 104*a*, 106*a* extending substantially laterally from each of the first and second major faces 104, 106 such that a U-shaped receiving channel 112 is formed whereby the intermediate portion 108 forms the base of the U-shaped receiving channel 112 and flange portions 104*a* and 106*a* respectively form opposing side arms of the U-shaped receiving channel 112. In the embodiment shown, the U-shaped receiving channel 112 is remote from the surface engaging portion 110. In an alternative embodiment, the surface engaging portion 110 is positioned adjacent to the U-shaped receiving channel 112. The size and shape of the U-shaped receiving channel 112 is such that a soffit material can be held securely within the interior of the U-shaped receiving channel 112 without the need to use additional fixing. Accordingly, in use, once the attachment devices have been located as desired on the exposed exterior surfaces under the roof structure, the soffit material can be placed and securely held in position without the need for additional fasteners.

In some embodiments, each of the central portion 102, the surface engaging portion 110 and the flange portions 104*a*, 106*a* are integrally formed with each other to form a single unit.

Figure 1D:
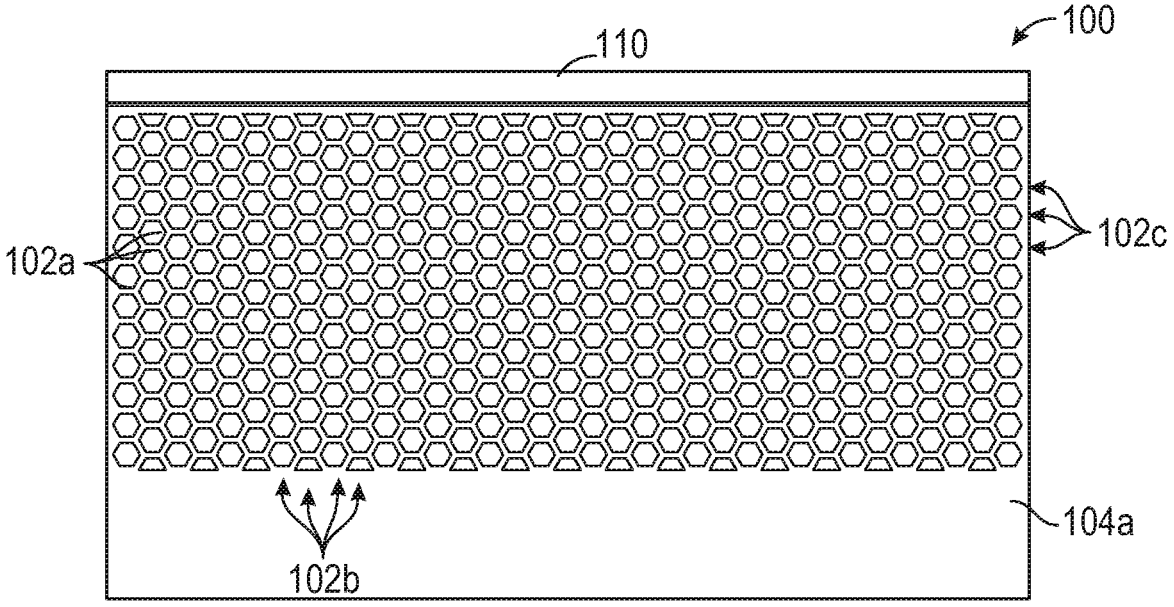
FIG. 1D is a top view of the attachment device of FIG. 1A.

In the example configuration of FIGS. 1A-1D, the plurality of apertures 102*a* within central portion 102 are provided as a continuous pattern in a series of columns 102*b* and rows 102*c*. Referring specifically to FIG. 1D, the cross-sectional shape of each aperture 102*a* is hexagonal, wherein the length of each side in the hexagonal shape is approximately 0.05". In this example configuration, the apertures may be large enough to meet one or more regulatory standards associated with roof ventilation (e.g., the Californian Building Code (CBC) 2016, Chapter 7A requirement of 1/16" diameter) but small enough to prevent insect intrusion.

In some embodiments, each aperture is configured to have either a circular or hexagonal cross sectional shape. Other suitable cross-sectional shapes could also be used, for example, square shapes, triangular shapes, any other regular or irregular polygonal shapes, oval, obround, or stadium shapes, and the like. In some implementations, circular or hexagonal cross sectional shapes as illustrated herein may provide advantageous aperture packing efficiency and strength in the designated vented section. In some embodiments, each aperture is between ⅛" and 1/16" in diameter.

Turning now to FIGS. 2A to 2D and 3A to 3D, there are shown further examples of the attachment device of the present disclosure which vary in a number of aspects such as, for example, the diameter size of the aperture, the cross-sectional shape of the aperture, the width of the central portion and/or attachment surface, etc. In the configuration illustrated in FIGS. 2A-2D, the diameter of the apertures 102*a* is 0.125". The apertures 102*a* of the configuration of FIGS. 3A-3D have a circular cross-sectional area.

Table One below provides several example configurations of packing arrangements and associated total vented surface area per square inch in the vented area of the attachment device (e.g., the vented portion of the central portion 102), for both a circular and hexagonal cross sectional shape with a diameter of 1/16" and ⅛" respectively.

One advantage of some embodiments of the vented attachment device 100 is that in addition to being used to secure soffit material to line the underside of eaves, apertures 102*a* enhance the natural flow of air through an attic space, because each aperture 102*a* will also allow cool air to be drawn in through the vented attachment device as a result of hotter air rising and exiting the attic space through the roof.

Various example dimensions of the attachment device 100 will now be provided. It will be understood that the following example dimensions may be implemented with any of the embodiments of the attachment device 100 described herein. In some embodiments, a length of the attachment device 100 along an axis parallel to both the attachment surface 110 and the central portion 102 is between approximately 6 inches and approximately 16 feet, or any length therebetween. For example, the length of the attachment device 100 may be between approximately 1 foot and approximately 12 feet, between approximately 2 feet and approximately 8 feet, etc. In some embodiments, the attachment device 100 has a length between approximately 3 feet and approximately 5 feet, for example, approximately 4 feet.

TABLE ONE

| Size | Type | Area (sq. in.) | Quantity | Surface area per type (sq. in.) | total surface area open for ventilation per sq. in. |
|---|---|---|---|---|---|
| 1/16" diameter | Hexagon | 0.002537 | 180 | 0.45666 | 0.48325 |
| | Partial 1 (top edge) | 0.000578 | 7 | 0.004046 | |
| | Partial 2 (top right corner) | 0.000093 | 1 | 0.000093 | |
| | Part 3 (right edge) | 0.000542 | 12 | 0.006504 | |
| | Partial 4 (small bottom edge) | 0.000014 | 7 | 0.000098 | |
| | Partial 5 (large bottom edge) | 0.001981 | 8 | 0.015848 | |
| | Partial 6 (bottom right corner) | 0.000001 | 1 | 0.000001 | |
| ⅛" diameter | Hexagon | 0.010149 | 56 | 0.568344 | 0.660865 |
| | Partial 1 (top edge) | 0.003683 | 4 | 0.014732 | |
| | Partial 2 (right edge) | 0.006256 | 7 | 0.043792 | |
| | Part 3 (bottom right corner) | 0.004041 | 1 | 0.004041 | |
| | Partial 4 (large bottom edge) | 0.006613 | 4 | 0.026452 | |
| | Partial 5 (small bottom edge) | 0.000876 | 4 | 0.003504 | |
| 1/16" diameter | Circle | 0.003068 | 121 | 0.371228 | 0.407679 |
| | Partial 2 (right edge) | 0.001922 | 11 | 0.021142 | |
| | Part 3 (bottom right corner) | 0.001217 | 11 | 0.013387 | |
| | Partial 4 (bottom edge) | 0.001922 | 1 | 0.001922 | |
| ⅛" diameter | Circle | 0.012272 | 36 | 0.441792 | 0.568627 |
| | Partial 2 (top right corner) | 0.00886 | 6 | 0.05316 | |
| | Part 3 (right edge) | 0.010525 | 6 | 0.06315 | |
| | Partial 4 (bottom edge) | 0.010525 | 1 | 0.010525 | |

Figure 2A:
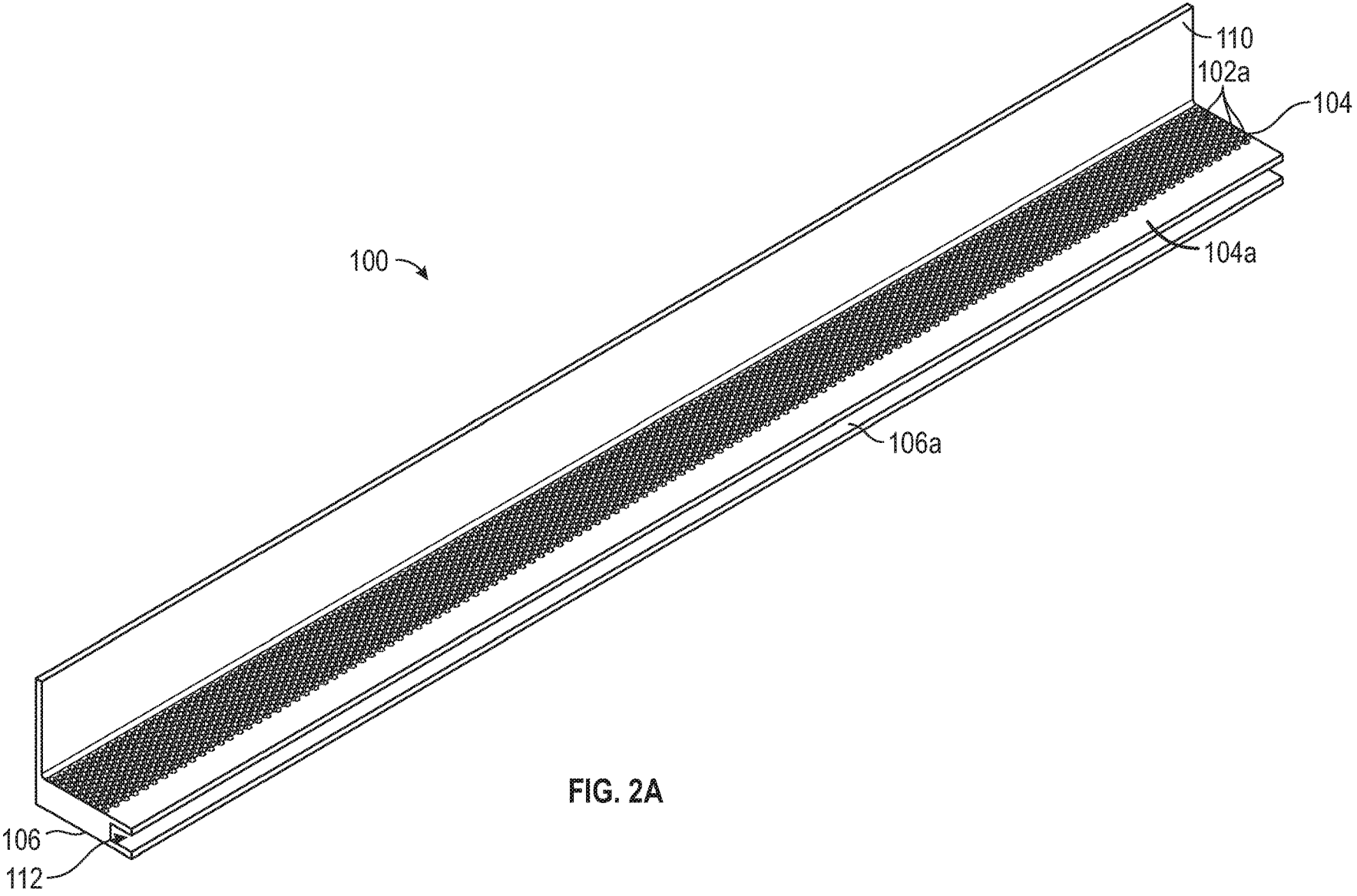
FIG. 2A is a perspective view of an example attachment device in accordance with the present technology.
Figure 2B:
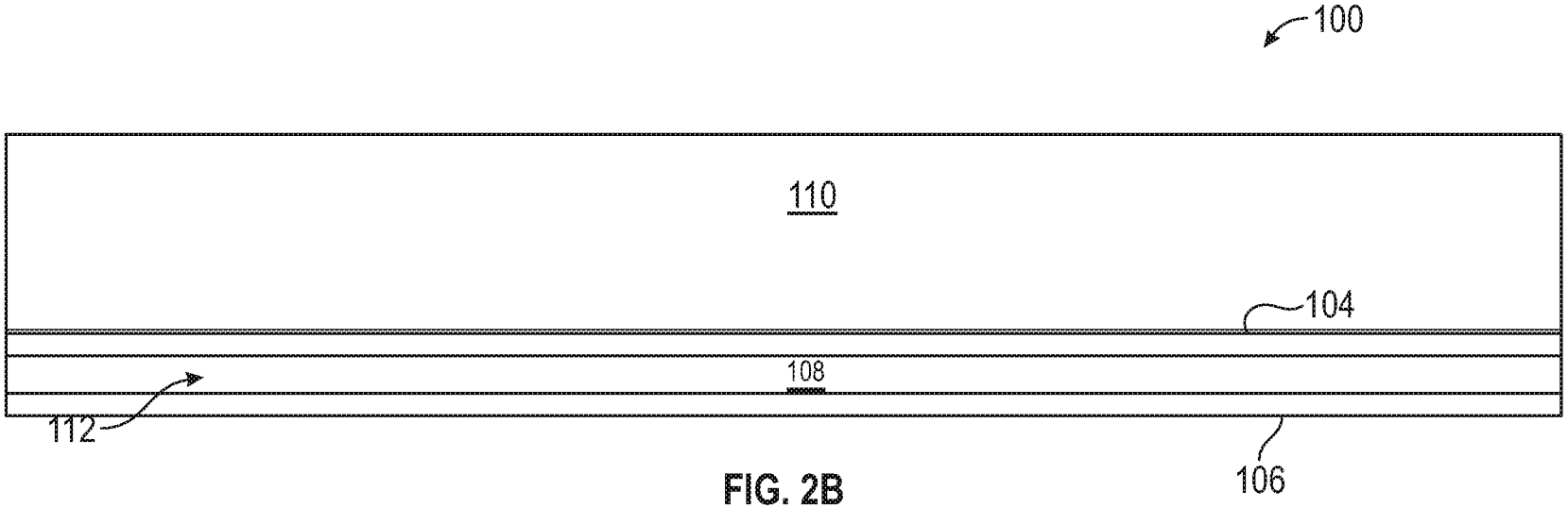
FIG. 2B is a front view of the attachment device of FIG. 2A.
Figure 2C:
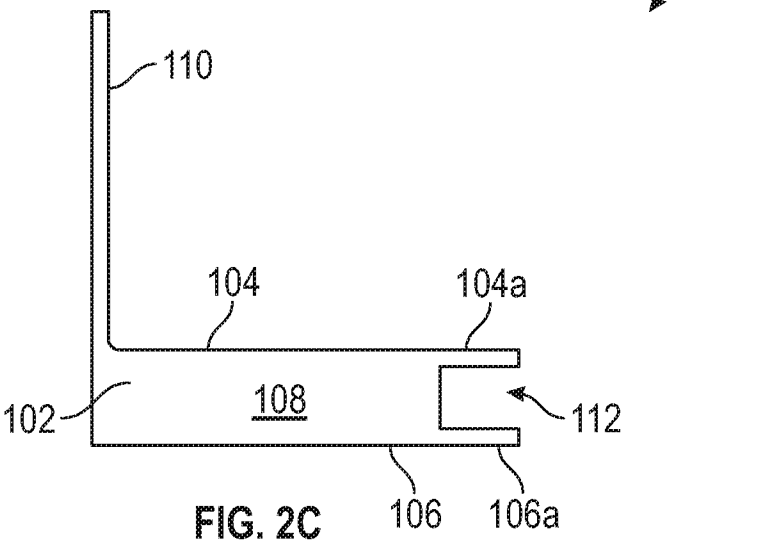
FIG. 2C is a side view of the attachment device of FIG. 2A.
Figure 2D:
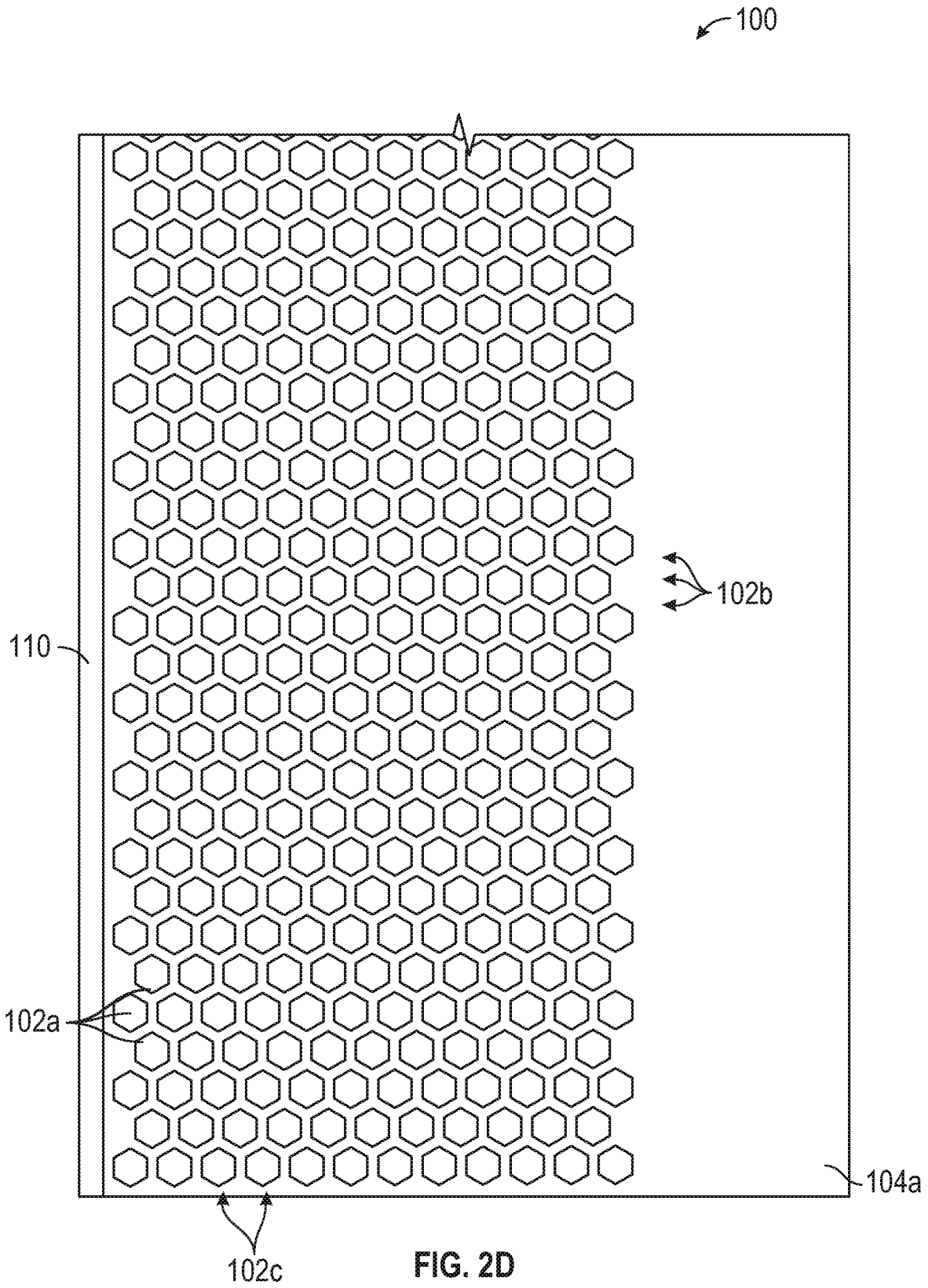
FIG. 2D is a top view of the attachment device of FIG. 2A.
Figure 3A:
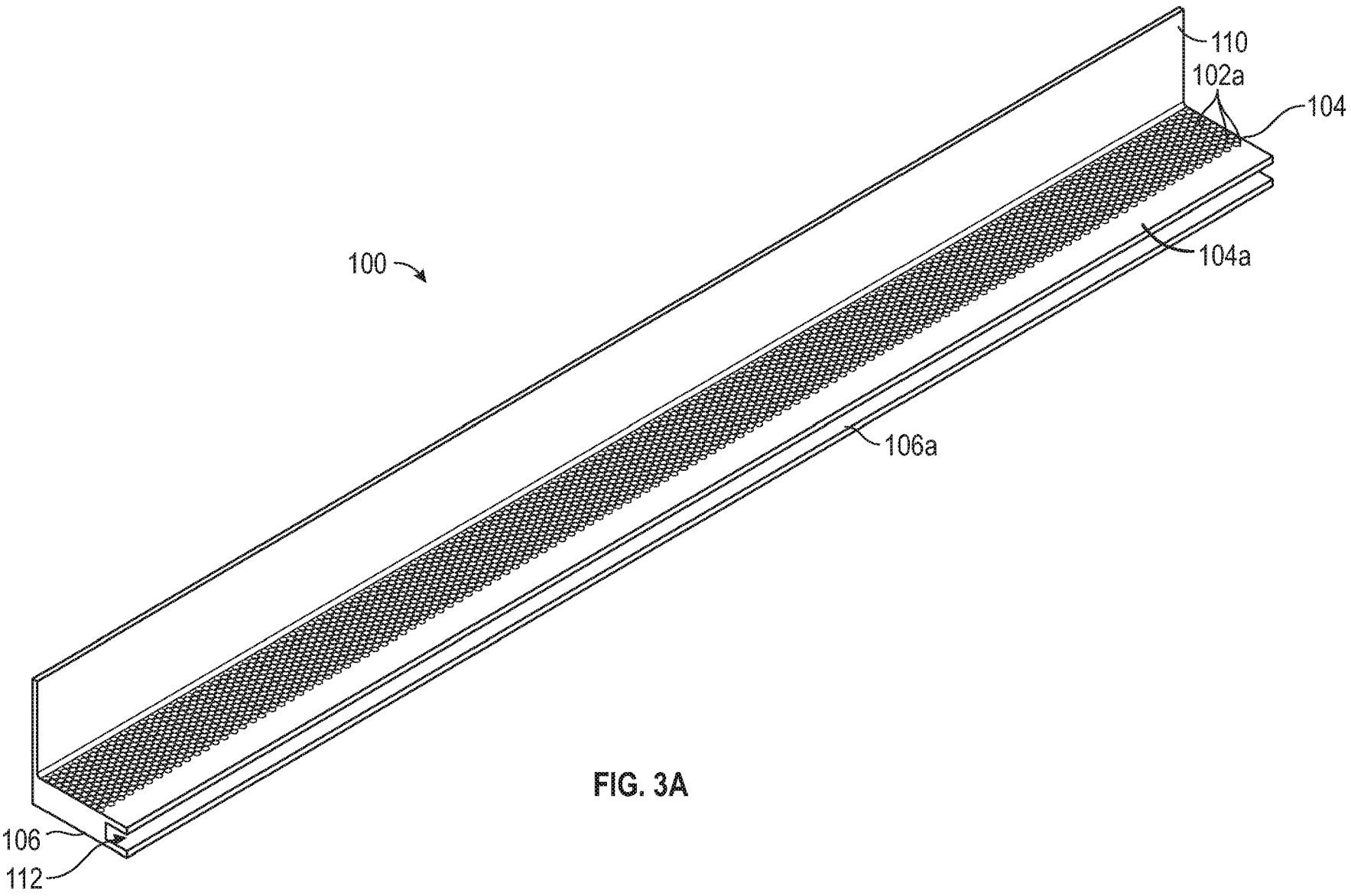
FIG. 3A is a perspective view of an example attachment device in accordance with the present technology.
Figure 3B:
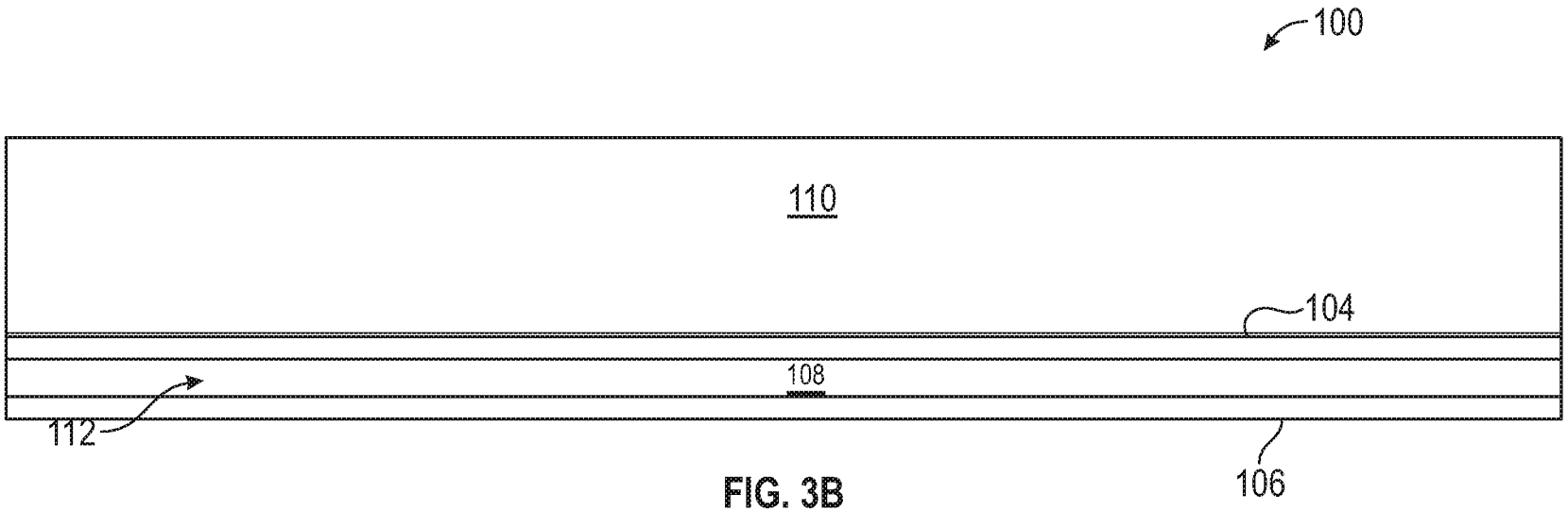
FIG. 3B is a front view of the attachment device of FIG. 3A.
Figure 3C:
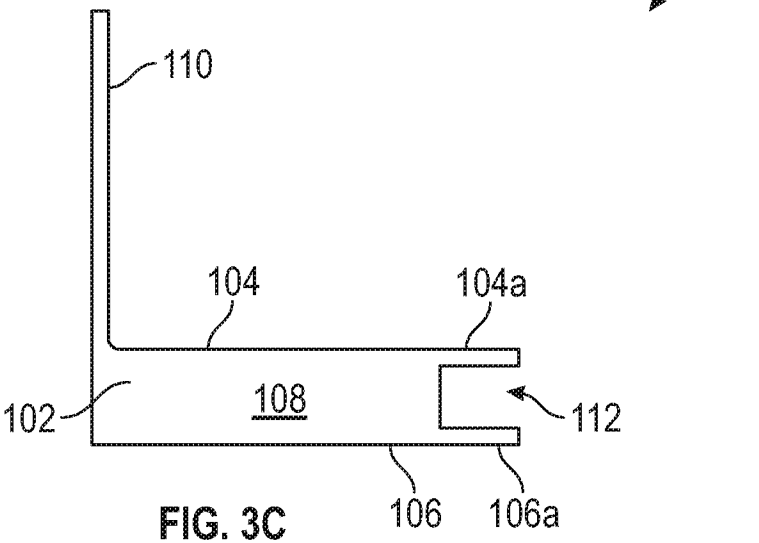
FIG. 3C is a side view of the attachment device of FIG. 3A.
Figure 3D:
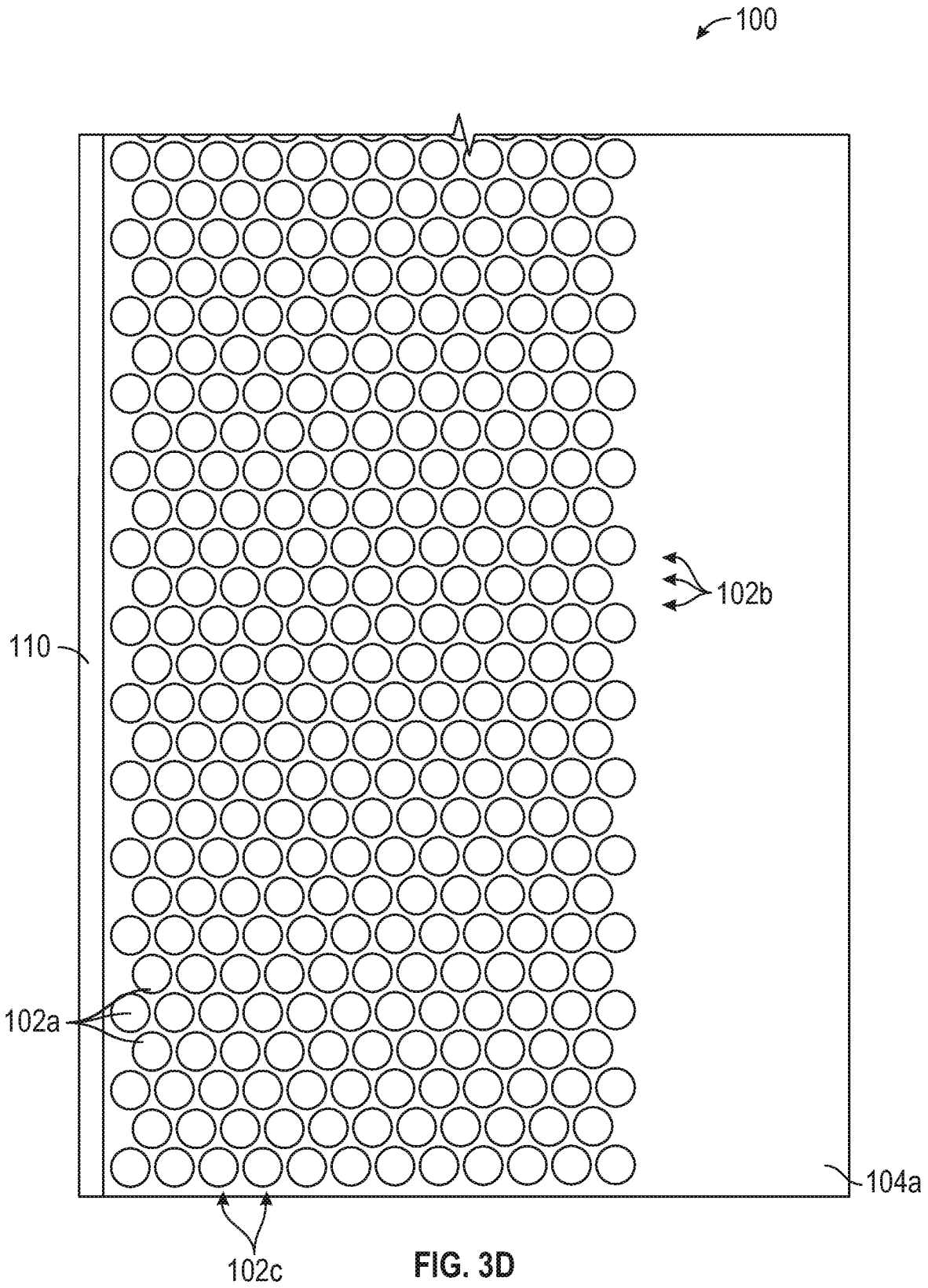
FIG. 3D is a top view of the attachment device of FIG. 3A.

Referring now specifically to FIGS. 1D, 2D, and 3D, there are shown enlarged top views of the aperture patterns of the attachment devices of FIGS. 1A, 2A, and 3A, respectively. The plurality of apertures may provide between approximately 0.41 square inches and 0.66 square inches total vented surface area per square inch of the ventilated area, thus the range of net free ventilation that could be achieved by these example embodiments varies between approximately 60 to 95 square feet of total vent area.

In some embodiments, each aperture is configured to act as an air inlet which allows cool air to be drawn in to the attic space when in use as a soffit material lining at least a portion of the underside of eaves. The net free ventilation figure is used to calculate how many feet of the vented attachment devices is required to line the underside of eaves based on the calculated Net Free Area (NFA) to achieve a balanced ventilation system for a particular roof system.

One advantage of certain embodiments of the attachment device is that there is an increase in the net free ventilation figure achieved by a roof system.

In some embodiments, a width of the attachment device 100 along an axis normal to the attachment surface 110 is between approximately 1 inch and approximately 6 inches, or any length therebetween. For example, the width may be any length between approximately 1.5 inches and approximately 4 inches. The flange portions 104*a*, 106*a* may comprise a portion of the width such as, for example, between approximately 0.432 inches and approximately 0.750 inches. The thickness of the attachment surface 110 may further comprise a portion of the width such as, for example, between approximately 0.63 inches and approximately 0.125 inches. The flange portions 104*a*, 106*a* may have the same thickness or may have different relative thicknesses. Each of the flange portions 104*a*, 106*a* may have a thickness such as between approximately 0.125 inches and approximately 0.25 inches. The width of the U-shaped receiving channel 112 (e.g., as measured from an inner surface of flange portion 104*a* to the opposing inner surface of flange portion 106*a*) may be, for example, between approximately 0.281 inches and approximately 0.313 inches. Accordingly, the central portion 102 may have a thickness equal to the sum of the flange thicknesses and the width of the U-shaped receiving channel 112. For example, an embodiment in which each flange has a thickness of approximately 0.25 inches and the U-shaped receiving channel 112 has a width of approximately 0.313 inches, the central portion 102 may have a thickness of approximately 0.563 inches.

The aperture pattern may cover a portion of the width of the attachment device 100. In one example, the portion of the width covered by the aperture pattern may be between approximately 1 inch and approximately 2 inches, for example, approximately 1.333 inches. The aperture pattern may cover the full length of the attachment device 100, or may cover a portion of less than the full length. In some embodiments, the aperture pattern may comprise a plurality of subsections of apertures. In one example, a subsection of apertures may have a length between approximately 3 inches and approximately 4 inches, for example, approximately 3.380 inches. The spacing between adjacent apertures may be any suitable spacing such as approximately 0.1 inches, 0.2 inches, 0.25 inches, 0.3 inches, 0.4 inches, 0.5 inches, or more, or any distance therebetween.

Generally described and with reference to FIGS. 4A-5, example installations of the attachment device 100 of FIGS. 1A to 1D will now be described. In the example installation of FIGS. 4A-5, a soffit material 150 is seated within the U-shaped receiving channel 112 of the attachment device 100. In various embodiments, the soffit material 150 may be a solid soffit material, or may include ventilation features integrally formed therein. The soffit material 150 may comprise any suitable soffit material, such as fiber cement, wood, metal, polymeric or composite materials, or any other suitably rigid soffit material. For clarity, certain components normally found in a roof structure, including the roof sheathing, underlayment and shingles, are not shown in FIG. 4A-5. Although the attachment devices 100 depicted in FIGS. 4A-5 are consistent with the attachment device 100 depicted in FIG. 1A to 1D, it will be appreciated that any of the attachment devices 100 of FIGS. 1A-3D may be installed in the same configuration.

Figure 4A:
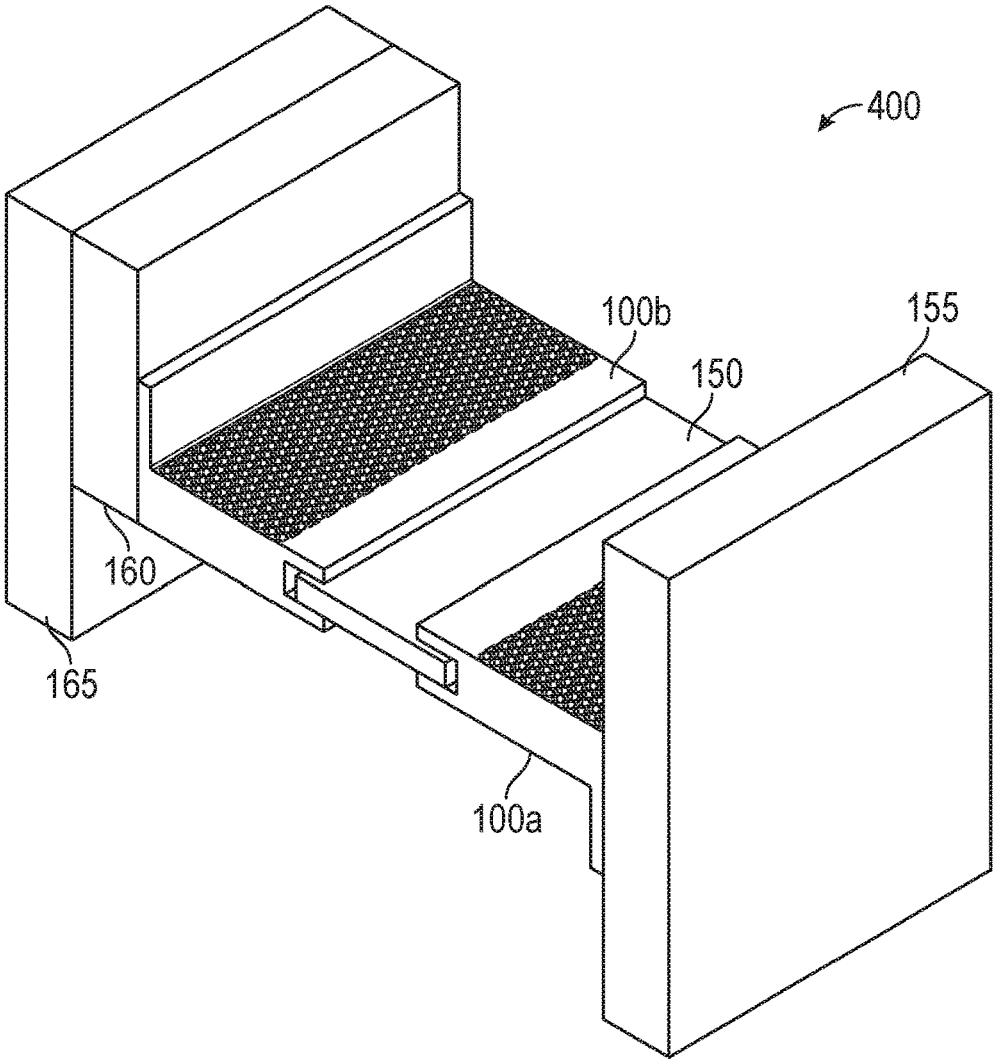
FIG. 4A is a perspective view of an exemplary soffit lining system comprising the attachment device of FIG. 1A together with an exemplary soffit material.
Figure 4B:
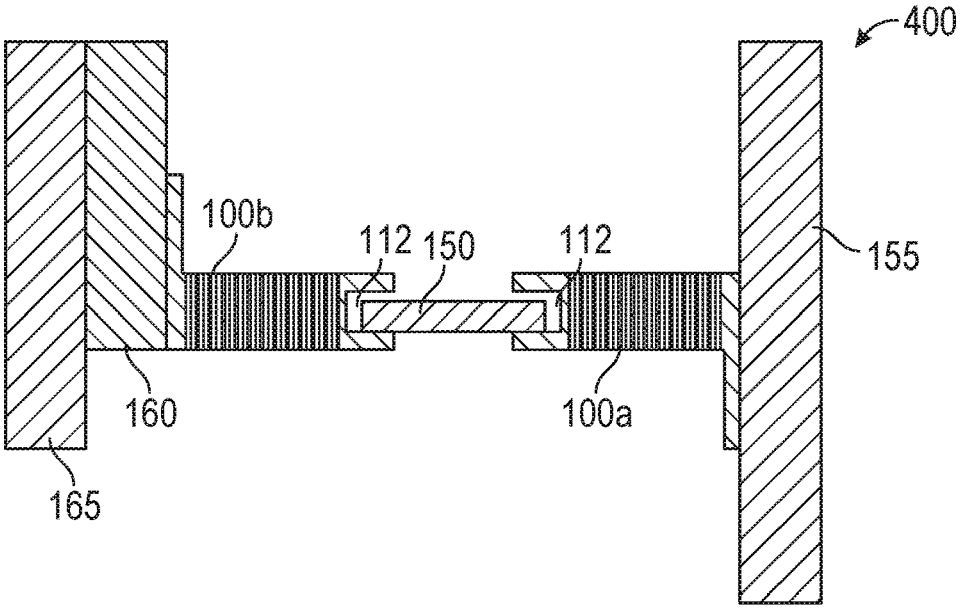
FIG. 4B is a side sectional view of the exemplary soffit lining system of FIG. 4A.
Figure 4C:
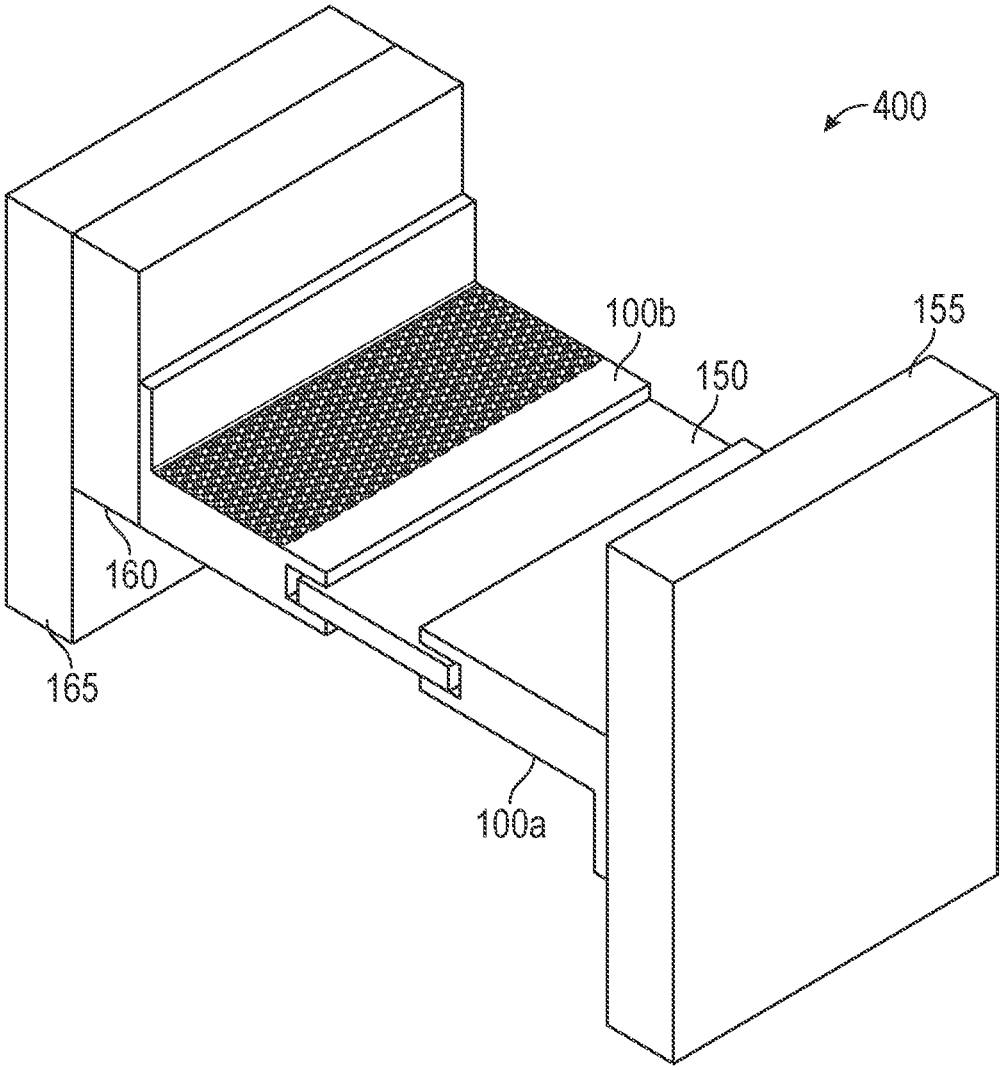
FIG. 4C is a perspective view of an alternative embodiment of the system of FIG. 4A in which one attachment device is non-ventilated.
Figure 5:
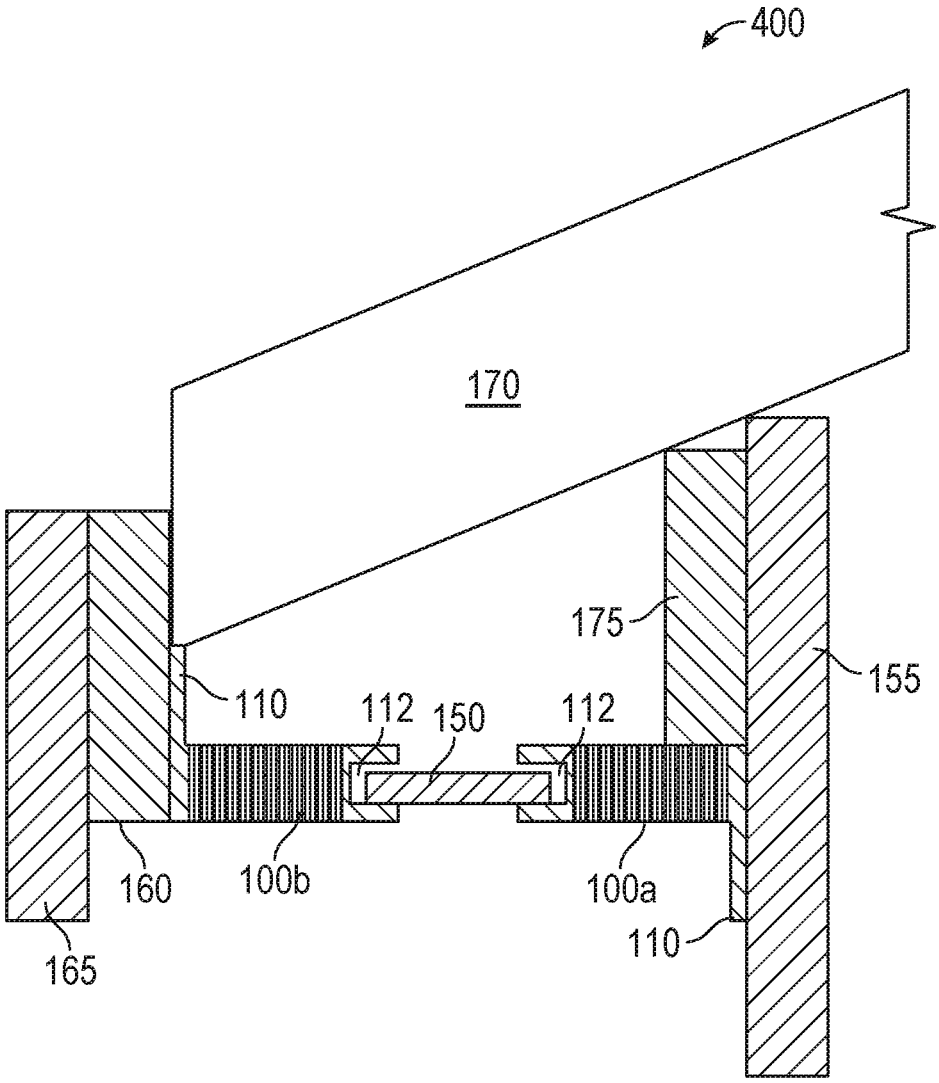
FIG. 5 is a side section view of a further exemplary soffit lining system.

Turning now to FIGS. 4A-4B, there is shown a soffit lining system 400 comprising at least two attachment devices 100*a*, 100*b*, and soffit material 150, wherein a first attachment device 100*a* is secured to a structural substrate, for example a wall 155, and a second attachment device 100*b* is secured to a material such as a sub-fascia 160 or a fascia 165, such that the U-shaped receiving channels 112 of each attachment device 100*a*, 100*b* are spaced apart and facing each other. Opposing sides of the soffit material 150 are seated within the U-shaped receiving channels 112 such that the soffit material 150 is held securely in position between the attachment devices 100*a*, 100*b* thereby lining the exposed exterior under surfaces of overhanging sections of a roof structure.

The attachment surface 110 of each attachment device 100*a*, 100*b* may be secured to the sub-fascia 160 and/or the wall 155 by one or more appropriate fasteners, such as nails, other mechanical fasteners, and/or one or more chemical fasteners such as adhesives.

In the example installation of FIGS. 4A-4B, both attachment devices 100*a*, 100*b* include apertures extending therethrough for ventilation as described herein. However, in some embodiments one or both of the attachment devices 100*a*, 100*b* may not include apertures. For example, in some embodiments such as in the example embodiment illustrated in FIG. 4C, a single ventilated attachment device 100*b* may provide sufficient ventilation, and a solid non-ventilated attachment device 100*a* may be used. In some embodiments, it may be preferable to place the ventilated attachment device 100 on the eave framing structure to maximise flow of air, laminar or otherwise through the apertures into the attic space. For example, it may be preferable to position the vented attachment device 100 toward the outside edge of the soffit lining system 400 (e.g., adjacent to the sub-fascia 160), rather than adjacent to the wall 155. This positioning may advantageously facilitate natural continuous air flow through the apertures of the example attachment device 100*b* through and out of the attic space.

Referring now to FIG. 5, a further example installed configuration is illustrated. Similar to the configuration of FIGS. 4A-4B, attachment devices 100*a*, 100*b* are secured to the building substrate 155 and the sub-fascia 160 to contain a soffit material 150 within the opposing u-shaped receiving channels 112 of the attachment devices 100*a*, 100*b*. FIG. 5 illustrates how one or more rafters 170 and/or one or more additional framing members 175 may further be installed in conjunction with the installed soffit lining system 400.

In practice, when using example embodiment attachment devices 100 and soffit material 150 to cover the exposed exterior under surface of the overhanging section of roof in the soffit lining system 400, adjacent soffit materials 150 and/or attachment devices 100 may be brought into contact with each other or alternately where a gap is formed, the gap may be covered to seal the exterior under surface. In certain embodiments the gap formed between adjacent components could be sealed using a filler, for example, caulk; using a connector, for example, a PVC or metal H molding; or alternatively using a cover, for example a batten.

In various embodiments, the attachment device 100 is formed from an appropriate material as deemed suitable by the person skilled in the art, for example a polymeric material, a suitable composite material, such as for example a fibre glass composite, a suitable metal, such as for example, aluminium. The attachment device 100 could be formed by injection moulding, extrusion or other such forming methods as known to a person skilled in the art. In a further embodiment, an intumescent material could also be included either on one surface or within the attachment device which would activate in the presence of a fire.

In a further embodiment, the attachment device could be textured and/or colour matched to the soffit material or surrounding area as desired by the end user.

Various wind load calculations have been carried out on the attachment device of the present disclosure. Specifically, the shear load that the lowest flange of the attachment device in situ can withstand when experiencing a downward pressure of 300 lb. per square foot. In such instances it is estimated that the attachment device can withstand a downward pressure of approximately 5479 psi. In a further embodiment, it is possible that the soffit material (e.g., soffit material 150) can also be nailed to cross members of an under roof structure to provide additional support and greater wind load resistance.

It will of course be understood that the invention is not limited to the specific details described herein, which are given by way of example only, and that various modifications and alterations are possible within the scope of the disclosure as defined in the appended claims.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practised using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A soffit lining system, comprising:

a first soffit panel attachment device coupled to a building substrate, the first soffit panel attachment device comprising a first attachment surface lying adjacent to the building substrate, a first central portion perpendicular to the building substrate and coupled to the first attachment surface at a first end of the first central portion, and a first plurality of flanges extending from the first central portion at a second end of the first central portion opposite the first end, the first plurality of flanges disposed parallel to the first central portion to form a first U-shaped channel aligned with the first central portion and opening away from the building substrate;

a second soffit panel attachment device coupled to a framing member spaced outwardly from the building substrate, the second soffit panel device comprising a second attachment surface lying adjacent to the framing member, a second central portion parallel to the first central portion and coupled to the second attachment surface at a first end of the second central portion, and a second plurality of flanges extending from the second central portion at a second end of the second central portion opposite the first end, the second plurality of flanges disposed parallel to the second central portion to form a second U-shaped channel aligned with the second central portion and opening toward the first U-shaped channel, wherein the second soffit panel attachment device comprises a plurality of openings extending through the second central portion; and a soffit panel having a substantially planar surface comprising a first edge and a second edge opposite the first edge, the soffit panel disposed at least partially within the first and second U-shaped channels, the first edge being disposed within the first U-shaped channel and resting on one of the first plurality of flanges, the second edge being disposed within the second U-shaped channel and resting on one of the second plurality of flanges, such that the first and second soffit panel attachment devices support the soffit panel along a length of the soffit panel.

2. The soffit lining system of claim 1, wherein the plurality of openings are oriented perpendicular to the soffit panel to provide an airflow path between a space below the soffit panel and a space above the soffit panel.

3. The soffit lining system of claim 2, wherein the plurality of openings comprise a regularly spaced grid of circular openings covering at least 0.4 square inches of each square inch of total surface area of the grid.

4. The soffit lining system of claim 2, wherein the plurality of openings comprise a regularly spaced grid of hexagonal openings covering at least 0.4 square inches of each square inch of total surface area of the grid.

5. The soffit lining system of claim 1, wherein the first soffit panel attachment device does not include a plurality of openings extending through the first central portion.

6. The soffit lining system of claim 1, wherein the first soffit panel attachment device includes a plurality of openings extending through the first central portion.

7. The soffit lining system of claim 6, wherein the first soffit panel attachment device is substantially identical to the second soffit panel attachment device.

8. The soffit lining system of claim 1, wherein the plurality of openings comprise a regularly spaced grid of hexagonal apertures.

9. The soffit lining system of claim 1, wherein the plurality of openings comprise a regularly spaced grid of circular apertures.

10. The soffit lining system of claim 1, wherein individual apertures of the plurality of apertures are spaced apart by a distance of between approximately 0.2 inches and approximately 0.3 inches.

11. The soffit lining system of claim 1, wherein each of the first and second soffit panel attachment devices comprises a single integrally formed piece of a polymeric material.

12. The soffit lining system of claim 1, wherein the plurality of openings generally define a ventilated area of the second central portion, and wherein the plurality of openings occupy at least 0.4 square inches of each square inch of the ventilated area.

13. The soffit lining system of claim 1, wherein each opening of the plurality of openings has a diameter of between approximately ⅛ inch and approximately 1/16 inch.

14. The soffit lining system of claim 1, wherein each of the first and second attachment surfaces comprises a plurality of apertures extending therethrough, each aperture of the plurality of apertures sized and shaped to receive a mechanical fastener therethrough.

15. The soffit lining system of claim 1, wherein a length of each of the first and second soffit panel attachment devices is between approximately 2 feet and approximately 8 feet.

16. The soffit lining system of claim 15, wherein the length of each of the first and second soffit panel attachment devices is approximately 4 feet.

* * * * *